United States Patent [19]

Caron et al.

[11] 4,305,762

[45] Dec. 15, 1981

[54] COPPER BASE ALLOY AND METHOD FOR OBTAINING SAME

[75] Inventors: Ronald N. Caron, Branford; W. Gary Watson, Cheshire; John F. Breedis, Trumbull, all of Conn.

[73] Assignee: Olin Corporation, New Haven, Conn.

[21] Appl. No.: 149,786

[22] Filed: May 14, 1980

[51] Int. Cl.[3] ..... C22C 9/00; C22C 9/06; C22F 1/08

[52] U.S. Cl. ..... 148/11.5 C; 75/153; 75/159; 148/12.7 C; 148/32; 148/32.5

[58] Field of Search ..... 148/11.5 C, 12.7 C, 148/32, 32.5, 160; 75/153, 154, 159, 164, 161

[56] References Cited

U.S. PATENT DOCUMENTS

| | | | |
|---|---|---|---|
| 2,128,955 | 9/1938 | Montgomery | 75/154 |
| 2,142,672 | 1/1939 | Hensel et al. | 148/160 |
| 2,171,697 | 9/1939 | Hensel et al. | 75/153 |
| 2,243,276 | 5/1941 | Hensel et al. | 75/153 |
| 3,143,442 | 8/1964 | Watts | 148/160 |
| 3,162,529 | 12/1964 | Doi | 75/153 |
| 3,392,016 | 7/1968 | Opie et al. | 75/153 |
| 3,535,094 | 10/1970 | Opie et al. | 428/636 |
| 3,574,001 | 4/1971 | Ence | 148/32.5 |
| 3,640,779 | 2/1972 | Ence | 148/32.5 |
| 3,677,745 | 7/1972 | Finlay et al. | 75/153 |
| 3,698,965 | 10/1972 | Ence | 148/32.5 |
| 3,778,318 | 12/1973 | Finlay et al. | 148/12.7 C |
| 3,923,558 | 12/1975 | Shapiro et al. | 148/12.7 C |
| 3,928,028 | 12/1975 | Yarwood | 75/153 |
| 3,976,477 | 8/1976 | Crane et al. | 75/153 |
| 4,198,248 | 4/1980 | Mandigo et al. | 148/2 |
| 4,202,688 | 5/1980 | Crane et al. | 75/153 |

FOREIGN PATENT DOCUMENTS

| | | | |
|---|---|---|---|
| 55-47337 | 4/1980 | Japan | 75/153 |

*Primary Examiner*—Peter K. Skiff
*Attorney, Agent, or Firm*—Paul Weinstein

[57] ABSTRACT

The disclosure teaches a high strength, high conductivity copper base alloy and method for obtaining same. The composition consists essentially of defined amounts of magnesium, phosphorus and a transition element selected from the group consisting of iron, cobalt, nickel and mixtures thereof with the balance essentially copper.

13 Claims, No Drawings

COPPER BASE ALLOY AND METHOD FOR OBTAINING SAME

BACKGROUND OF THE INVENTION

It is highly desirable to provide a relatively low cost copper base alloy which will obtain a combination of high electrical conductivity with favorable strength and ductility characteristics and with excellent softening resistance.

Modern applications, for example in the electronics industry for lead frames, heat sinks and other electrical connectors, place many stringent requirements on copper base alloys. These electronic devices, for example, must withstand elevated temperature excursions without softening during manufacture. In addition, applications such as aforesaid require high thermal conductivity and good softening resistance while retaining high strength. Other applications also place stringent requirements on copper base alloys while, of course, emphasizing moderate cost.

Thus, it is highly desirable to provide copper base alloys which have high thermal and electrical conductivities together with good strength and good bend formability and resistance to fracture during multiple bending. Specifically, it would be highly desirable to provide copper base alloys which are characterized by moderate cost and which are capable of obtaining a 90% IACS electrical conductivity together with good softening resistance and a good combination of strength to bend properties.

U.S. Pat. Nos. 3,677,745 and 3,778,318 teach a copper base alloy containing defined amounts of magnesium and phosphorus together with preferred additions of silver and/or cadmium. Naturally, the silver addition in such an alloy represents a high cost factor. In addition, it has been found that the alloy of these patents, while obtaining good electrical conductivity, can be deficient in softening resistance.

In addition to the foregoing, the art teaches that high conductivity and high softening resistance may be obtained with copper base alloys containing zirconium such as U.S. Pat. Nos. 3,143,442 and 3,392,016. However, it has been found that these alloys are lacking in good strength/formability characteristics. U.S. Pat. No. 3,698,965 teaches a high strength copper alloy containing defined amounts of iron, cobalt and phosphorus plus magnesium and/or tin; however, the conductivity of this alloy falls only in the 50 to 60% IACS range.

Accordingly, it is a principal object of the present invention to provide improved copper base alloys having a good combination of conductivity and strength characteristics.

It is a further object of the present invention to provide such a copper base alloy which is characterized by high electrical and thermal conductivity together with favorable strength and ductility combinations and also with excellent softening resistance.

It is a further object of the present invention to provide an alloy as aforesaid which is relatively inexpensive and which may be conveniently processed.

Further objects and advantages of the present invention will appear hereinbelow.

SUMMARY OF THE INVENTION

In accordance with the present invention, it has now been found that the foregoing objects and advantages may be readily obtained.

The present invention resides in a high strength, high conductivity copper base alloy consisting essentially of magnesium from 0.04 to 0.20%, preferably from 0.04 to 0.12%, phosphorus from 0.04 to 0.20%, preferably from 0.04 to 0.12%, a transition element selected from the group consisting of iron, cobalt, nickel and mixtures thereof in a total amount of from 0.04 to 0.20%, preferably from 0.04 to 0.12%, and the balance essentially copper, wherein the microstructure is characterized by the presence of substantially uniformly dispersed fine phosphide particles. The phosphide particles are generally less than 0.5 micron in size and are phosphides of magnesium and the transition elements. The preferred transition element is iron or cobalt. In a preferred embodiment, in order to obtain a minimum conductivity of 85% IACS, one should control the magnesium content in accordance with the formula $Mg=(1.18P)\pm0.06$ wherein Mg is the magnesium content and P is the phosphorus content. Still further, in order to obtain a minimum conductivity of 90% IACS, one should control the magnesium content in accordance with the formula $Mg=(1.18P-0.01)\pm0.02$ wherein Mg and P have the meanings set out above.

In addition to the foregoing, it has been found in accordance with the present invention that a high strength copper base alloy may be readily obtained with improved conductivity by providing a copper base alloy preferably in strip form consisting essentially of from 0.04 to 0.20% magnesium, from 0.04 to 0.20% phosphorus, a transition element selected from the group consisting of iron, cobalt, nickel and mixtures thereof in a total amount of from 0.04 to 0.20% and the balance essentially copper, heat treating said alloy at a temperature of 250° to 750° C. for 10 seconds to 24 hours, cold working said alloy and finally heat treating said alloy at a temperature of from 250° to 600° C. for ½ hour to 24 hours to provide a high strength, high conductivity copper base alloy. Preferred ranges for magnesium, phosphorus and transition element are as indicated above. The microstructure is characterized by the presence of a substantially uniform dispersion of fine phosphide particles as aforesaid.

Within the scope of the foregoing process, numerous process variations may be applied in order to obtain particularly desirable characteristics in the end product as will be discussed hereinbelow.

In accordance with the present invention, the foregoing copper alloys are characterized by highly desirable characteristics at a reasonable cost. A family of hot and cold workable copper base alloys are provided which provide high electrical and thermal conductivity together with favorable strength and ductility combinations and also with excellent softening resistance. The alloys are easily and conveniently processed in accordance with commercial practice and, particularly desirably, are characterized by reasonable cost. Further features of the alloy and method of the present invention will be discussed hereinbelow.

DETAILED DESCRIPTION

The copper base alloys of the present invention contain specifically defined amounts of alloying additions. The magnesium content will range from 0.04 to 0.20%, the phosphorus content will range from 0.04 to 0.20%, and the transition element content will range from 0.04 to 0.20% in total. Optimum properties are obtained when all ranges are from 0.04 to 0.12%. Either iron, cobalt or nickel may be used as the transition element with iron or cobalt being preferred. As indicated hereinabove, in order to obtain a minimum conductivity of 85% IACS, one should control the magnesium content in accordance with the formula $Mg=(1.18\ P)\pm0.06$, and in order to obtain a minimum conductivity of 90% IACS, one should control the magnesium content in accordance with the formula $Mg=(1.18\ P-0.01)\pm0.02$, wherein Mg is the magnesium content and P is the phosphorus content.

Throughout the present specification where percentages of ingredients are employed, weight percentages are intended.

In addition to the foregoing, the microstructure of the alloys of the present invention is characterized by the presence of a substantially uniform dispersion of phosphide particles which are phosphides of magnesium and the transition elements, with the magnesium phosphide particles predominating. The particles are generally less than 0.5 micron in size. The processing of the present invention is intended to maximize the dispersion of these particles which contributes to the excellent properties of the alloy of the present invention. In addition, it is desirable in accordance with the present invention to utilize the specifically balanced combinations of magnesium with phosphorus and transition element with phosphorus in order to minimize the amount of alloying elements left in solid solution. This will ensure a good combination of electrical conductivity and softening resistance characteristics. For example, one should have less than the following amounts of the following materials left in solid solution: phosphorus—less than 0.02%, magnesium—less than 0.03%, and transition element—less than 0.03%.

As indicated hereinabove, the foregoing alloy is characterized by an excellent combination of physical properties. The alloy has high conductivity and excellent softening resistance. In addition, the alloy has good bend formability.

Additional alloying elements may be included in the composition of the present invention provided that they do not substantially interfere with the excellent characteristics of the present alloys. In addition, conventional impurities may be readily tolerated by the alloy of the present invention.

The alloy of the present invention may be readily processed in accordance with commercial practice. The alloy may be cast in any convenient manner with the particular method of casting not being critical. For example, one may readily employ direct chill or continuous casting methods. It is a particular advantage of the alloy of the present invention that the excellent conductivity values obtained in the final product do not require the use of oxygen-free copper as the initial charge, nor of melting and casting within a vacuum or inert gas environment. The alloying elements employed may be readily protected with the judicious and appropriate prior addition of one or more deoxidizing agents in a conventional manner.

If desired, the alloy may be homogenized at temperatures between 600° C. and the solidus temperature for periods of at least 5 minutes. In addition, if necessary the alloy may be hot worked from a starting temperature in excess of 600° C. with the particular temperature depending on the particular composition. The finishing temperature should be in excess of 350° C. A solution annealing treatment may be employed following hot working or as part of the hot working procedure, i.e., for from 10 seconds to 24 hours at 600° to 1000° C.

Hereinafter, throughout the present specification, rolling will be discussed as the preferred working step; however, it should be understood that other working operations are contemplated in accordance with the method of the present invention, such as drawing, extruding, or the like.

After hot rolling, the alloy is cold rolled at a temperature below 200° C. with or without intermediate annealing. It is a particular advantage of the present invention that the instant alloys have excellent hot and cold rollability. It is a particular feature of the method of the present invention to utilize a preliminary or first heat treatment step followed by an aging or final heat treatment step with an intermediate cold rolling step. In accordance with the present invention, the first annealing step commences to the preparation of the substantially uniform dispersion of particles of phosphides of the present invention, and the subsequent aging step completes the provision of this dispersion thus significantly contributing to the excellent properties of the present invention. Also, an improvement in conductivity is obtained thereby.

The first annealing step is at a temperature of from 250° to 750° C. for from 10 seconds to 24 hours with strip or bell annealing techniques being readily employed. The aging step is at a temperature of from 250° to 600° C. for from 30 minutes to 24 hours using a bell anneal. Naturally, reductions will depend upon the particular gauge requirements.

The final condition of the alloy may be in the annealed or aged condition or in the cold worked condition. In addition, the alloy of the present invention may also be subjected to a stress relief anneal following fabrication into a useful article, with said stress relief annealing being conducted at a temperature of from 100° to 350° C. for from 10 seconds to 24 hours.

The present invention and advantages thereof will be more readily apparent from a consideration of the following illustrative examples.

EXAMPLE I

Three alloys were prepared in accordance with the processing of the present invention and within the composition of the present invention identified as Alloys 1 and 2 having a composition set forth below:

| | | |
|---|---|---|
| Alloy 1 | Cobalt | 0.08% |
| | Magnesium | 0.04% |
| | Phosphorus | 0.06% |
| | Copper | substantially balance |
| Alloy 2 | Iron | 0.08% |
| | Magnesium | 0.04% |
| | Phosphorus | 0.06% |
| | Copper | substantially balance |

Ten pound ingots were prepared for each of these alloys. High purity elemental additions were melted in air under a charcoal cover and the melts were poured from 1250° C. and solidified as a 4×4×1.8" ingot via the Durville process. The ingots were homogenized at 825° C. for 1½ hours from which temperature they were hot rolled from 1.8" to 0.40" thickness in a seven pass rolling schedule. The resulting material was milled and trimmed to remove mill scale followed by cold rolling to 0.120" gauge, annealing for one hour at 600° C. and cold rolling to 0.040" gauge. The material was then subjected to an aging treatment at 425° C. for 3 hours followed by cold rolling with a 25% reduction in thickness to 0.030" gauge at which gauge various physical and mechanical properties were determined as set forth in Table IA below. The microstructures of the alloys of the present invention were characterized by the presence of substantially uniformly dispersed, fine phosphide particles.

The comparison properties were determined for commercial copper base alloy C15500 as well as for two zirconium containing copper base alloys. These comparative materials are identified as Alloys 3, 4 and 5 and the compositions thereof are set forth below.

| | | |
|---|---|---|
| Alloy 3 | Zirconium | 0.08% |
| | Niobium | 0.09% |
| | Copper | substantially balance |
| Alloy 4 | Zirconium | 0.08% |
| | Chromium | 0.09% |
| | Copper | substantially balance |
| Alloy 5 | (commercial alloy C15500) | |
| | Magnesium | 0.14% |
| | Phosphorus | 0.06% |
| | Silver | 0.03% |
| | Copper | substantially balance |

Both Alloys 3 and 4 were Durville cast from 1300° C. Alloy 3 was hot rolled after a 2 hour homogenization at 825° C. The material was milled and trimmed to remove mill scale followed by cold rolling to 0.120" gauge, solution treating at 800° C. for 30 minutes and cold rolling to 0.048" gauge. The material was aged for one hour at 500° C. followed by cold rolling 37% to 0.030" gauge and its properties measured. Alloy 4 was hot rolled from 925° C. after a 2 hour homogenization treatment at that temperature. After milling it was cold rolled to 0.120" gauge, solution annealed at 800° C. for 30 minutes and cold rolled to 0.045" gauge. After an aging treatment at 525° C. for one hour, the metal was cold rolled 33% to 0.030" gauge and its properties measured. Alloy 5 was a commercially obtained material. From a soft temper at 0.10" the metal was rolled at 0.048" gauge, given an aging anneal for 3 hours at 425° C. and cold rolled 37% to 0.030" gauge where its properties were measured. All properties are shown in Table IA below. The electrical conductivity values and tensile properties are listed in Table IA together with the results of the transverse bend formability property test. This bend property test determines the minimum radius about which a strip can be bent 90° without cracking. The transverse orientation indicates that the bend axis is parallel to the rolling direction. The minimum bend radius (MBR) is the smallest die radius about which the strip can be bent 90° without showing cracks, and t is the thickness, i.e. all at 0.030" gauge. The softening resistance was determined by hardness measurements on cold rolled samples exposed for various times in a salt bath at 500° C. Exposure times correspond to those in molten salt followed by a water quench. Generally, times of 30 seconds to one minute can be experienced during the die attach operation of bonding silicon chips to lead frames. These data are shown in Table IB. The data of Table IA show that the alloys of the present invention processed in accordance with the present invention, i.e. Alloys 1 and 2, have better ductility as measured by percent elongation and bend formability than the copper-zirconium Alloys 3 and 4 when compared at equal strength and electrical conductivity values. The data in Table IB show that the alloys of this invention possess the excellent softening resistance of the copper-zirconium base alloys (Alloys 3 and 4) but are superior to commercial alloy C15500 (Alloy 5), especially after 5 minutes at 500° C.

TABLE IA

| | PROPERTIES AT 0.030" | | | | |
|---|---|---|---|---|---|
| Alloy | Electrical Conductivity % IACS | 0.2% Yield Strength ksi | Tensile Strength ksi | Tensile Elongation % | Transverse MBR/t |
| 1 | 90.2 | 58 | 60 | 6.0 | 1.0 |
| 2 | 90.6 | 54 | 57 | 7.8 | 1.0 |
| 3 | 93.7 | 60 | 62 | 2.8 | 2.0 |
| 4 | 92.8 | 57 | 58 | 3.5 | 3.0 |
| 5 | 89.0 | 58 | 60 | 5.5 | 0.5 |

TABLE IB

| | SOFTENING DATA Hardness, Rockwell-15t | | | | |
|---|---|---|---|---|---|
| | Exposure Time in Salt Bath, Minutes, at 500° C. | | | | |
| Alloy | 0 | 0.5 | 1 | 5 | 60 |
| 1 | 83 | 79 | 79 | 75 | — |
| 2 | 83 | 83 | 82 | 82 | 73 |
| 3 | 83 | 79 | 79 | 78 | 78 |
| 5 | 84 | 82 | 81 | 69 | 63 |

EXAMPLE II

This example compares the softening resistance of the alloys of the present invention with the softening resistance of Alloy 5, a commercial copper base alloy C15500. A number of alloys of the present invention were prepared in a manner after Example I having the composition set forth in Table IIA. All alloys were processed as in Example I using a first anneal at 600° C. for one hour followed by cold rolling, followed by an aging treatment at 425° C. for 3 hours. Properties were determined for 25% cold rolled material. The comparative commercial alloy C15500 was a commercially obtained material which was processed in a manner after Example I with properties determined for 25% cold rolled material. The properties are shown in Table IIB. The softening data for commercial alloy C15500 shows the best and worst properties of a number of commercial lots of the alloy which have a nominal composition as in alloy 5. The data clearly establish that the alloys of the present invention possess improved softening resistance than commercial alloy C15500. The microstructures of Alloys 6–19 were characterized by the presence of substantially uniformly dispersed, fine phosphide particles.

TABLE IIA

| | COMPOSITIONS | | |
|---|---|---|---|
| Alloy | Iron - % | Magnesium - % | Phosphorus - % |
| 6 | 0.050 | 0.042 | 0.050 |
| 7 | 0.048 | 0.079 | 0.074 |
| 8 | 0.051 | 0.124 | 0.107 |
| 9 | 0.080 | 0.084 | 0.081 |
| 10 | 0.079 | 0.118 | 0.112 |
| 11 | 0.109 | 0.048 | 0.064 |
| 12 | 0.124 | 0.084 | 0.093 |
| 13 | 0.123 | 0.124 | 0.121 |
| 14 | 0.078 | 0.078 | 0.046 |
| 15 | 0.080 | 0.082 | 0.104 |
| 16 | 0.079 | 0.052 | 0.083 |
| 17 | 0.076 | 0.122 | 0.084 |

TABLE IIA-continued

| Alloy | COMPOSITIONS Iron - % | Magnesium - % | Phosphorus - % |
|---|---|---|---|
| 18 | 0.049 | 0.084 | 0.083 |
| 19 | 0.118 | 0.084 | 0.079 |

TABLE IIB

SOFTENING DATA FOR 25% COLD ROLLED METAL AT 0.030" GAUGE - ROCKWELL-15t

| Alloy | 500° C. Salt Bath - Exposure Time - Minutes 0 | 0.25 | 0.5 | 1 | 5 | 60 |
|---|---|---|---|---|---|---|
| 6 | 84 | 81 | 81 | 81 | 61 | 61 |
| 7 | 85 | 80 | 80 | 80 | 64 | 58 |
| 8 | 86 | 82 | 81 | 82 | 77 | 65 |
| 9 | 85 | 81 | 82 | 81 | 79 | 61 |
| 10 | 85 | 82 | 82 | 83 | 77 | 63 |
| 11 | 85 | 82 | 80 | 82 | 81 | 67 |
| 12 | 85 | 82 | 81 | 82 | 82 | 68 |
| 13 | 87 | 83 | 82 | 83 | 83 | 73 |
| 14 | 84 | 81 | 81 | 82 | 80 | 61 |
| 15 | 86 | 80 | 82 | 82 | 77 | 65 |
| 16 | 84 | 82 | 82 | 82 | 74 | 49 |
| 17 | 85 | 82 | 82 | 82 | 81 | 65 |
| 18 | 85 | 82 | 82 | 80 | 65 | 63 |
| 19 | 86 | 82 | 82 | 82 | 81 | 67 |
| C15500 best lots | 84 | — | 82 | 81 | 69 | 63 |
| C15500 worst lots | 80 | — | 64 | 64 | 60 | 61 |

EXAMPLE III

This example determines the effect of iron level on electrical conductivity. A series of alloys with varying iron contents (0.050 to 1.02%) and containing 0.085% Mg and 0.085% P were processed in a manner after Example I using a first anneal of 475° C. for 8 hours and a second anneal of 425° C. for 8 hours followed by a final cold reduction of 37.5% to 0.019" gauge. The data show that electrical conductivity decreases monotonically with increasing iron content as clearly shown in Table III, below.

TABLE III

ELECTRICAL CONDUCTIVITY WITH VARYING IRON CONTENTS IN Cu—Fe-0.085% Mg-0.085% P ALLOYS IN COLD ROLLED (37.5%) TEMPER

| IRON CONTENT, % | ELECTRICAL CONDUCTIVITY, % IACS |
|---|---|
| 0.050 | 94 |
| 0.080 | 92 |
| 0.10 | 91 |
| 0.20 | 85 |
| 0.38 | 77 |
| 0.50 | 74 |
| 0.80 | 70 |
| 1.02 | 68 |

EXAMPLE IV

This example shows the beneficial effect upon conductivity of the two anneal process as compared to a one anneal process. Several alloys of composition set out in Table IVA below were processed as in Example I to 0.120" gauge. Following 0.120" gauge, the alloys were subjected to varying processing conditions as set out in Table IVB below. The resultant conductivity is shown in Table IVC below and demonstrates the improved conductivity with a two anneal process. Note the poor conductivity for Alloy 24 which contains less magnesium than the alloys of the present invention.

TABLE IVA

| Alloy | COMPOSITIONS Iron - % | Magnesium - % | Phosphorus - % |
|---|---|---|---|
| 20 | 0.077 | 0.078 | 0.048 |
| 21 | 0.080 | 0.082 | 0.104 |
| 22 | 0.078 | 0.12 | 0.084 |
| 23 | 0.079 | 0.106 | 0.042 |
| 24 | 0.070 | 0.036 | 0.102 |

TABLE IVB

IDENTIFICATION OF PROCESSING CONDITIONS OF ALLOYS INITIALLY COLD ROLLED TO 0.120" GAUGE FROM HOT ROLLED PLATE

| Processing Condition | Processing Sequence to Test Gauge |
|---|---|
| 1 | Anneal 470° C.-4 Hrs., CR to 0.030", Anneal 470° C.-4 Hrs. |
| 2 | Anneal 470° C., CR to 0.030", Anneal 470° C.-4 Hrs., CR 37% to 0.019" |
| 3 | CR to 0.030", Anneal 470° C.-4 Hrs. |
| 4 | CR to 0.030", Anneal 470° C.-4 Hrs., CR 37% to 0.019" |

TABLE IVC

| Alloy | CONDUCTIVITY Processing Condition | Conductivity, % IACS |
|---|---|---|
| 20 | 1 | 90.4 |
| | 2 | 89.3 |
| | 3 | 87.0 |
| | 4 | 86.3 |
| 21 | 1 | 90.8 |
| | 2 | 88.1 |
| | 3 | 90.5 |
| | 4 | 89.9 |
| 22 | 1 | 89.3 |
| | 2 | 87.7 |
| | 3 | 85.7 |
| | 4 | 85.4 |
| 23 | 1 | 86.7 |
| | 2 | 85.4 |
| | 3 | 83.0 |
| | 4 | 82.0 |
| 24 | 1 | 75.4 |
| | 2 | 76.6 |
| | 3 | 76.4 |
| | 4 | 76.2 |

EXAMPLE V

This example shows the excellent mechanical properties for the alloys of the present invention. Alloys 6, 9 and 13 were tested representing a range of alloy compositions. The alloys were processed in a manner after Example I with a first anneal of 600° C. for 1 hour, cold rolling, finally annealing at 425° C. for 3 hours with testing under the various conditions noted. The data measured for these alloys in Table V below show their excellent properties under various conditions.

TABLE V

MECHANICAL PROPERTIES AT 0.030" GAUGE

| Alloy | Condition | 0.2 YS ksi | UTS ksi | Elong-ation % | MBR/t Good Way | MBR/t Bad Way |
|---|---|---|---|---|---|---|
| 6 | Annealed | 19 | 43 | 32.2 | — | — |
| | CR 25% | 53 | 55 | 6.5 | <0.2 | <0.2 |
| | CR 37.5% | 54 | 57 | 5.5 | 0.3 | 0.3 |
| | CR 60% | 62 | 65 | 4.0 | 0.3 | 1.0 |
| | CR 75% | 65 | 68 | 4.2 | 1.0 | 1.0 |

TABLE V-continued

| MECHANICAL PROPERTIES AT 0.030" GAUGE | | | | | | |
|---|---|---|---|---|---|---|
| | | 0.2 YS | UTS | Elong- | MBR/t | |
| Alloy | Condition | ksi | ksi | ation % | Good Way | Bad Way |
| 9 | Annealed | 20 | 44 | 31.5 | — | — |
| | CR 25% | 54 | 57 | 7.0 | <0.2 | <0.2 |
| | CR 37.5% | 57 | 59 | 5.2 | 0.3 | 0.3 |
| | CR 60% | 65 | 68 | 4.5 | 1.0 | 1.0 |
| | CR 75% | 67 | 70 | 4.0 | 1.0 | 1.6 |
| 13 | Annealed | 27 | 49 | 26.0 | — | — |
| | CR 25% | 59 | 62 | 5.2 | 0.3 | 0.3 |
| | CR 37.5% | 60 | 63 | 5.2 | 0.5 | 0.5 |
| | CR 60% | 67 | 70 | 4.2 | 1.0 | 1.6 |
| | CR 75% | 67 | 71 | 4.2 | 1.6 | 1.6 |

EXAMPLE VI

The following example shows the excellent properties of the cobalt containing alloy of the present invention. The alloy was prepared in a manner after Example I and had a composition of 0.08% cobalt, 0.07% magnesium and 0.09% phosphorus. The alloys were processed in a manner after Example I and cold rolled to 0.030" gauge using differing conditions for the first and final anneals. Conductivity data are shown in Table VI below and amply demonstrate the excellent properties of the cobalt containing alloy of the present invention.

TABLE VI

| ELECTRICAL CONDUCTIVITY VALUES | | | |
|---|---|---|---|
| First Anneal | Conductivity, % IACS at 0.030" | | |
| Conditions | CR 75% | 425° C.-3 hours | 450° C.-8 hours |
| 600° C.-1 hour | 75.9 | 91.2 | 91.8 |
| 500° C.-3 hours | 85.8 | 91.8 | 92.0 |
| 425° C.-3 hours | 85.4 | 92.3 | 92.4 |
| 450° C.-3 hours | 84.2 | 92.1 | 91.8 |
| 450° C.-8 hours | 87.0 | 92.0 | 92.6 |
| 470° C.-4 hours | 89.0 | 92.6 | 92.7 |

This invention may be embodied in other forms or carried out in other ways without departing from the spirit or essential characteristics thereof. The present embodiment is, therefore, to be considered as in all respects illustrative and not restrictive, the scope of the invention being indicated by the appended claims, and all changes which come within the meaning and range of equivalency are intended to be embraced therein.

What is claimed is:

1. A high strength, high conductivity copper base alloy consisting essentially of magnesium from 0.04 to 0.20%, phosphorus from 0.04 to 0.20%, a transition element selected from the group consisting of iron, cobalt, nickel and mixtures thereof in a total amount of from 0.04 to 0.20% and the balance essentially copper, wherein the microstructure is characterized by the presence of a substantially uniform dispersion of fine phosphide particles.

2. An alloy according to claim 1 wherein magnesium, phosphorus and transition elements are present in an amount from 0.04 to 0.12%.

3. An alloy according to claim 1 wherein said phosphide particles are less than about 0.5 micron in size and are phosphides of magnesium and the transition elements.

4. An alloy according to claim 1 having a minimum conductivity of 85% IACS wherein the magnesium content is in accordance with the formula $Mg=(1.18P)\pm0.06$, with Mg being the magnesium content and P being the phosphorus content.

5. An alloy according to claim 1 having a minimum conductivity of 90% IACS wherein the magnesium content is in accordance with the formula $Mg=(1.18P-0.01)\pm0.02$, with Mg being the magnesium content and P being the phoshorus content.

6. An alloy according to claim 1 wherein less than the following amounts of materials are left in solid solution, phosphorus—less than 0.02%, magnesium—less than 0.03%, and transition element—less than 0.03%.

7. An alloy according to claim 1 wherein said alloy is copper base alloy strip.

8. A method for obtaining high conductivity, high strength copper base alloys which comprises: providing a copper base alloy consisting essentially of magnesium from 0.04 to 0.20%, phosphorus from 0.04 to 0.20%, a transition element selected from the group consisting of iron, cobalt, nickel and mixtures thereof in a total amount of from 0.04 to 0.20%; heat treating said alloy for from 10 seconds to 24 hours at a temperature of from 250° to 750° C.; cold rolling said alloy; and finally heat treating said alloy for from 30 minutes to 24 hours at a temperature of from 250° to 600° C.

9. A method according to claim 8 wherein magnesium, phosphorus and transition elements are present in an amount from 0.04 to 0.12%.

10. A method according to claim 8 wherein said first heat treatment is selected from the group consisting of strip annealing and bell annealing and said final heat treatment is a bell anneal.

11. A method according to claim 8 wherein the final product is in the annealed temper.

12. A method according to claim 8 wherein the final product is in the cold rolled temper.

13. A method according to claim 8 wherein said copper base alloy is provided in strip form.

* * * * *